US009956760B2

(12) United States Patent
Kanungo et al.

(10) Patent No.: US 9,956,760 B2
(45) Date of Patent: May 1, 2018

(54) MULTILAYER IMAGING BLANKET COATING

(71) Applicant: Xerox Corporation, Norwalk, CT (US)

(72) Inventors: Mandakini Kanungo, Penfield, NY (US); Santokh S. Badesha, Pittsford, NY (US); David J. Gervasi, Pittsford, NY (US); Phillip J. Wantuck, Rochester, NY (US); Anton Grigoryev, Sarativ (RU); Kevin H. Taft, Williamson, NY (US); Xing Xin Liu, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days. days.

(21) Appl. No.: 14/576,734

(22) Filed: Dec. 19, 2014

(65) Prior Publication Data

US 2016/0176185 A1 Jun. 23, 2016

(51) Int. Cl.

| | |
|---|---|
| ***B41J 2/01*** | (2006.01) |
| *B41J 2/385* | (2006.01) |
| *G03G 9/08* | (2006.01) |
| *B41J 2/005* | (2006.01) |

(52) U.S. Cl.

CPC ..... *B41J 2/01* (2013.01); *B41J 2/0057* (2013.01); *B41J 2002/012* (2013.01); *G03G 2215/1623* (2013.01)

(58) Field of Classification Search

CPC ..... B41J 2/01; B41J 2/0057; B41J 2002/012
USPC ..... 347/101, 103, 154
See application file for complete search history.

(56) References Cited

U.S. PATENT DOCUMENTS

| | | | |
|---|---|---|---|
| 3,945,957 | A | 3/1976 | Noshiro et al. |
| 4,304,601 | A | 12/1981 | Sharp |
| 4,339,553 | A | 7/1982 | Yoshimura et al. |
| 4,403,550 | A | 9/1983 | Sharp |
| 4,445,432 | A | 5/1984 | Ford, Jr. et al. |
| 4,711,818 | A | 12/1987 | Henry |
| 4,806,391 | A | 2/1989 | Shorin |
| 4,911,999 | A | 3/1990 | Legere |
| 4,927,180 | A | 5/1990 | Trundle et al. |
| 4,970,098 | A | 11/1990 | Ayala-Esquilin et al. |
| 4,997,642 | A | 3/1991 | Curtis et al. |

(Continued)

FOREIGN PATENT DOCUMENTS

| | | |
|---|---|---|
| EP | 1235863 B1 | 1/2005 |
| EP | 1900527 A1 | 3/2008 |

(Continued)

OTHER PUBLICATIONS

Kanungo et al., "Fluoroelastomers for Marking System Component, Including Grafted Fluorinated Polymers", U.S. Appl. No. 13/931,983, filed Jun. 30, 2013.

(Continued)

*Primary Examiner* — Sharon A Polk
(74) *Attorney, Agent, or Firm* — MH2 Technology Law Group LLP

(57) ABSTRACT

A multilayer imaging blanket comprises a seamless belt. A silicone layer is disposed on the belt. The silicone layer comprises silicone rubber and a metal oxide filler. A fluoroelastomer surface layer is disposed on the silicone layer. Printing apparatuses employing the multilayer imaging blanket are also disclosed.

18 Claims, 3 Drawing Sheets

(56) References Cited

U.S. PATENT DOCUMENTS 5,085,698 A 2/1992 Ma et al.
5,145,518 A 9/1992 Winnik et al.
5,146,087 A 9/1992 Vandusen
5,202,265 A 4/1993 LaMora
5,208,630 A 5/1993 Goodbrand et al.
5,225,900 A 7/1993 Wright
5,231,135 A 7/1993 Machell et al.
5,256,193 A 10/1993 Winnik et al.
5,271,764 A 12/1993 Winnik et al.
5,275,647 A 1/1994 Winnik
5,286,286 A 2/1994 Winnik et al.
5,301,044 A 4/1994 Wright
5,378,574 A 1/1995 Winnik et al.
5,385,803 A 1/1995 Duff et al.
5,464,703 A 11/1995 Ferrar et al.
5,474,852 A 12/1995 Fitzgerald et al.
5,494,702 A 2/1996 Blaine et al.
5,502,476 A 3/1996 Neal et al.
5,539,038 A 7/1996 Katsen et al.
5,543,177 A 8/1996 Morrison et al.
5,547,759 A 8/1996 Chen et al.
5,554,480 A 9/1996 Patel et al.
5,593,807 A 1/1997 Sacripante et al.
5,621,022 A 4/1997 Jaeger et al.
5,629,416 A 5/1997 Neigel et al.
5,695,878 A 12/1997 Badesha et al.
5,700,568 A 12/1997 Badesha et al.
5,736,520 A 4/1998 Bey et al.
5,744,200 A 4/1998 Badesha et al.
5,750,204 A 5/1998 Badesha et al.
5,753,307 A 5/1998 Badesha et al.
5,834,118 A 11/1998 Ranby et al.
5,841,456 A 11/1998 Takei et al.
5,886,067 A 3/1999 Li et al.
5,945,245 A 8/1999 Mychajlowskij et al.
5,977,202 A 11/1999 Chawla et al.
6,020,300 A 2/2000 Tcheou et al.
6,042,227 A 3/2000 Meinhardt et al.
6,051,562 A 4/2000 Chamberlain et al.
6,103,815 A 8/2000 Mammino et al.
6,114,489 A 9/2000 Vicari et al.
6,156,858 A 12/2000 Keoshkerian et al.
6,221,137 B1 4/2001 King et al.
6,329,446 B1 12/2001 Sacripante et al.
6,348,509 B1 2/2002 Reeve
6,348,561 B1 2/2002 Mychajlowskij et al.
6,586,100 B1 7/2003 Pickering et al.
6,664,015 B1 12/2003 Sacripante et al.
6,896,937 B2 5/2005 Woudenberg
7,022,752 B2 4/2006 Hayashi et al.
7,151,153 B2 12/2006 Bruchmann et al.
7,172,276 B2 2/2007 Breton et al.
7,202,006 B2 4/2007 Chopra et al.
7,202,883 B2 4/2007 Breton et al.
7,208,258 B2 4/2007 Gervasi et al.
7,281,790 B2 10/2007 Mouri et al.
7,294,377 B2 11/2007 Gervasi et al.
7,322,688 B2 1/2008 Woudenberg
7,374,812 B2 5/2008 Mizuno
7,538,070 B2 5/2009 Iftime et al.
7,556,844 B2 7/2009 Iftime et al.
7,608,325 B2 10/2009 Rasch et al.
7,674,326 B2 3/2010 Iftime et al.
7,708,396 B2 5/2010 Iftime et al.
7,718,325 B2 5/2010 Norsten et al.
7,723,398 B2 5/2010 Ilg et al.
7,767,011 B2 8/2010 Bedford et al.
7,780,286 B2 8/2010 Yahiro
7,909,924 B2 3/2011 Krishnan et al.
7,964,271 B2 6/2011 Norsten et al.
8,001,889 B2 8/2011 Gaugenrieder et al.
8,038,284 B2 * 10/2011 Hori et al. ..... 347/103
8,124,791 B2 2/2012 Shinjo et al.
8,136,936 B2 3/2012 Hook et al.
8,142,557 B2 3/2012 Belelie et al.
8,158,693 B2 4/2012 Breton et al.
8,215,762 B2 7/2012 Ageishi
8,222,313 B2 7/2012 Iftime et al.
8,247,066 B2 8/2012 Wu
8,268,399 B2 9/2012 Gervasi et al.
8,350,879 B2 1/2013 Larson et al.
8,500,269 B2 8/2013 Morita
8,771,787 B2 7/2014 Breton et al.
8,895,400 B2 11/2014 Seo et al.
8,919,252 B2 12/2014 Lestrange et al.
8,934,823 B1 1/2015 Pickering et al.
9,011,594 B1 4/2015 Kanungo et al.
9,022,546 B1 5/2015 Breton et al.
9,126,430 B2 9/2015 Liu
9,138,985 B1 9/2015 Yang et al.
9,174,432 B2 11/2015 Liu et al.
9,187,587 B2 11/2015 Kanungo et al.
9,193,209 B2 * 11/2015 Dooley ..... B41J 2/01
9,211,697 B2 12/2015 Dooley et al.
9,227,393 B2 1/2016 Song et al.
9,283,795 B1 3/2016 Kanungo et al.
9,353,290 B2 * 5/2016 Condello ..... C09D 183/10
9,387,661 B2 7/2016 Zirilli
9,422,436 B2 8/2016 Birau et al.
2002/0040073 A1 4/2002 Stone et al.
2002/0064648 A1 5/2002 Schlueter et al.
2002/0107303 A1 8/2002 Miyabashi et al.
2003/0003323 A1 1/2003 Murakami et al.
2003/0021961 A1 1/2003 Ylitalo et al.
2003/0044691 A1 3/2003 Setthachayanon et al.
2003/0067528 A1 4/2003 Chowdry et al.
2003/0073762 A1 4/2003 Jung et al.
2003/0149130 A1 8/2003 Kondo
2003/0233952 A1 12/2003 Pan et al.
2003/0233953 A1 * 12/2003 Pan et al. ..... 101/217
2003/0234840 A1 * 12/2003 Pan et al. ..... 347/84
2004/0063809 A1 4/2004 Fu et al.
2004/0132862 A1 7/2004 Woudenberg
2004/0158056 A1 8/2004 Hiemstra et al.
2004/0233465 A1 11/2004 Coyle et al.
2004/0253436 A1 * 12/2004 Heeks et al. ..... 428/328
2005/0018027 A1 1/2005 Pan et al.
2005/0166783 A1 8/2005 Ylitalo et al.
2006/0008599 A1 1/2006 Hiyama
2006/0054040 A1 3/2006 Daems et al.
2006/0105117 A1 5/2006 Kim et al.
2006/0110611 A1 5/2006 Badesha et al.
2006/0147659 A1 7/2006 Foley
2006/0152566 A1 7/2006 Taniuchi et al.
2007/0073762 A1 3/2007 Adamson et al.
2007/0166479 A1 7/2007 Drake et al.
2007/0207186 A1 9/2007 Scanlon et al.
2007/0207269 A1 9/2007 Woodhall et al.
2007/0259986 A1 11/2007 Elwakil et al.
2007/0266896 A1 11/2007 Suwa et al.
2008/0032072 A1 2/2008 Taniuchi et al.
2008/0055381 A1 * 3/2008 Doi et al. ..... 347/103
2008/0090929 A1 4/2008 Wilson et al.
2008/0139743 A1 6/2008 Krishnan et al.
2008/0206571 A1 8/2008 Berckmans et al.
2008/0241485 A1 10/2008 Shimohara et al.
2008/0258345 A1 10/2008 Bens et al.
2008/0317957 A1 12/2008 Overbeek et al.
2009/0038506 A1 2/2009 Odell et al.
2009/0104373 A1 4/2009 Vanbesien et al.
2009/0110843 A1 4/2009 Halahmi et al.
2009/0110942 A1 4/2009 Henderson-Rutgers et al.
2009/0135239 A1 5/2009 Chretien et al.
2009/0152664 A1 6/2009 Klem et al.
2009/0195579 A1 8/2009 Tousi et al.
2009/0237479 A1 9/2009 Yamashita et al.
2009/0280302 A1 11/2009 Fukumoto et al.
2010/0020123 A1 1/2010 Hirato
2010/0067056 A1 3/2010 Rich et al.
2010/0214373 A1 8/2010 Carr et al.
2010/0239777 A1 9/2010 Nakajima et al.
2011/0018925 A1 1/2011 Ohara
2011/0025752 A1 2/2011 Law et al.
2011/0045199 A1 2/2011 Cong

(56) References Cited

U.S. PATENT DOCUMENTS

| | | | |
|---|---|---|---|
| 2011/0122195 | A1 | 5/2011 | Kovacs et al. |
| 2011/0122210 | A1 | 5/2011 | Sambhy et al. |
| 2011/0141187 | A1 | 6/2011 | Takabayashi |
| 2011/0188023 | A1 | 8/2011 | Rondon et al. |
| 2011/0196058 | A1 | 8/2011 | Breton et al. |
| 2011/0262711 | A1 | 10/2011 | Chopra et al. |
| 2011/0269849 | A1 | 11/2011 | Yao et al. |
| 2012/0039648 | A1 | 2/2012 | Sambhy et al. |
| 2012/0040156 | A1 | 2/2012 | Ohashi et al. |
| 2012/0042518 | A1 | 2/2012 | Law et al. |
| 2012/0083530 | A1 | 4/2012 | Mai et al. |
| 2012/0103212 | A1 | 5/2012 | Stowe et al. |
| 2012/0103213 | A1 | 5/2012 | Stowe et al. |
| 2012/0103218 | A1 | 5/2012 | Stowe et al. |
| 2012/0103221 | A1 | 5/2012 | Stowe et al. |
| 2012/0121827 | A1 | 5/2012 | Baird et al. |
| 2012/0135650 | A1 | 5/2012 | Servante et al. |
| 2012/0140009 | A1 | 6/2012 | Kanasugi et al. |
| 2012/0157561 | A1 | 6/2012 | Gould et al. |
| 2012/0162312 | A1 | 6/2012 | Ahl et al. |
| 2012/0251685 | A1 | 10/2012 | Wang-Nolan et al. |
| 2012/0274914 | A1* | 11/2012 | Stowe et al. ..... 355/53 |
| 2012/0283098 | A1 | 11/2012 | Zhang et al. |
| 2012/0301818 | A1 | 11/2012 | Gilmartin et al. |
| 2013/0050366 | A1 | 2/2013 | Sasada et al. |
| 2013/0104756 | A1 | 5/2013 | Stowe et al. |
| 2013/0266803 | A1 | 10/2013 | Dooley et al. |
| 2013/0272763 | A1 | 10/2013 | Moorlag et al. |
| 2013/0305946 | A1 | 11/2013 | Iftime et al. |
| 2013/0305947 | A1 | 11/2013 | Iftime et al. |
| 2013/0307913 | A1 | 11/2013 | Kawashima et al. |
| 2013/0310479 | A1 | 11/2013 | Lee et al. |
| 2013/0310517 | A1 | 11/2013 | Lee et al. |
| 2013/0324653 | A1 | 12/2013 | Bollard et al. |
| 2014/0060352 | A1 | 3/2014 | Gervasi et al. |
| 2014/0060357 | A1 | 3/2014 | Hsieh |
| 2014/0060359 | A1 | 3/2014 | Kanungo et al. |
| 2014/0060360 | A1 | 3/2014 | Moorlag et al. |
| 2014/0060361 | A1 | 3/2014 | Gervasi et al. |
| 2014/0060363 | A1 | 3/2014 | Kelly et al. |
| 2014/0060365 | A1 | 3/2014 | Gervasi et al. |
| 2014/0154377 | A1 | 6/2014 | Wang-Nolan et al. |
| 2014/0168330 | A1 | 6/2014 | Liu et al. |
| 2014/0235752 | A1 | 8/2014 | Gharapetian et al. |
| 2014/0307800 | A1 | 10/2014 | Sole Rojals et al. |
| 2014/0333704 | A1 | 11/2014 | Takabayashi et al. |
| 2014/0340455 | A1 | 11/2014 | Breton et al. |
| 2015/0004861 | A1 | 1/2015 | Gervasi et al. |
| 2015/0022602 | A1 | 1/2015 | Landa et al. |
| 2015/0031806 | A1 | 1/2015 | Lim et al. |
| 2015/0077501 | A1 | 3/2015 | Breton et al. |
| 2015/0085036 | A1 | 3/2015 | Liu |
| 2015/0085039 | A1 | 3/2015 | Liu |
| 2015/0093690 | A1 | 4/2015 | Shimura et al. |
| 2015/0116414 | A1 | 4/2015 | Eliyahu et al. |
| 2015/0119510 | A1 | 4/2015 | Eliyahu et al. |
| 2015/0165758 | A1 | 6/2015 | Sambhy et al. |
| 2015/0170498 | A1 | 6/2015 | Beggs et al. |
| 2015/0174887 | A1 | 6/2015 | Moorlag et al. |
| 2015/0175820 | A1 | 6/2015 | Breton et al. |
| 2015/0175821 | A1 | 6/2015 | Moorlag et al. |
| 2015/0258778 | A1 | 9/2015 | Dooley et al. |
| 2015/0267078 | A1 | 9/2015 | Dooley |
| 2015/0275022 | A1 | 10/2015 | Chen et al. |
| 2015/0291847 | A1 | 10/2015 | Condello et al. |
| 2015/0315403 | A1 | 11/2015 | Song et al. |
| 2015/0315409 | A1 | 11/2015 | Song et al. |
| 2015/0343797 | A1 | 12/2015 | Song et al. |
| 2016/0083606 | A1 | 3/2016 | Sisler et al. |
| 2016/0083607 | A1 | 3/2016 | Sisler et al. |
| 2016/0083609 | A1 | 3/2016 | Sisler et al. |
| 2016/0083636 | A1 | 3/2016 | Yoshida et al. |
| 2016/0090490 | A1 | 3/2016 | Moorlag et al. |
| 2016/0177113 | A1 | 6/2016 | Allen et al. |
| 2016/0222231 | A1 | 8/2016 | Allen et al. |
| 2016/0230027 | A1 | 8/2016 | Birau et al. |
| 2016/0237290 | A1 | 8/2016 | Moorlag et al. |
| 2016/0257829 | A1 | 9/2016 | Breton et al. |
| 2016/0264798 | A1 | 9/2016 | Allen et al. |
| 2016/0280949 | A1 | 9/2016 | Song et al. |
| 2016/0326376 | A1 | 11/2016 | Song et al. |
| 2016/0333205 | A1 | 11/2016 | Lee et al. |
| 2017/0015115 | A1 | 1/2017 | Chen et al. |
| 2017/0051155 | A1 | 2/2017 | Larson et al. |
| 2017/0192374 | A1 | 7/2017 | Landa et al. |

FOREIGN PATENT DOCUMENTS

| | | | |
|---|---|---|---|
| EP | 2228690 | A1 | 9/2010 |
| JP | 03069954 | A | 3/1991 |
| JP | 2011208019 | A | 10/2011 |
| WO | 2005047385 | A1 | 5/2005 |
| WO | 2013119539 | A1 | 8/2013 |

OTHER PUBLICATIONS

Chen et al., "A New Imaging Plate Coating Composite Composed of Fluoroelastomer and Aminosilane Crosslinkers", U.S. Appl. No. 14/229,350, filed Mar. 28, 2014.

Condello et al., "Transfix Surface Member Coating", U.S. Appl. No. 14/250,482, filed Apr. 11, 2014.

Dooley et al., "Infrared Reflective Pigments in a Transfix Blanket in a Printer", U.S. Appl. No. 14/180,829, Feb. 14, 2014.

Gervasi et al., "Grafted Polymers as Oleophobic or Hydrophobic Coatings," U.S. Appl. No. 14/161,178 filed Jan. 22, 2014.

Varun Sambhy et al., "Indirect Printing Apparatus Employing Sacrificial Coating on Intermediate Transfer Member", U.S. Appl. No. 14/105,498, filed Dec. 13, 2013.

Brynn Dooley et al., "Transfix Surface Member Coating", U.S. Appl. No. 14/219,481, filed Mar. 19, 2014.

Kanungo et al., "Methods for Forming Functionalized Carbon Black with Amino-Terminated Polyfluorodimethylsiloxane for Printing", U.S. Appl. No. 14/041,508, filed Sep. 30, 2013.

"Dimer Acids," Kirk-Othmer Encyclopedia of Chemical Technology, vol. 8, 4th Ed. (1992), pp. 223-237.

Author Unknown, "Chemical reactions on the "finished" silicone", Silicones Europe, http://www.silicones.eu/science-research/chemistry/chemical-reactions-on-the-finished-silicone, accessed Dec. 13, 2014, pp. 1-4.

Jikei et al. "Synthesis and Properties of Hyperbranched Aromatic Polyamide Copolymers from AB and AB2 Monomers by Direct Polycondensation", Macromolecules 2000, 33, pp. 6228-6234 (2000).

Song, et al., "Compositions and Use of Compositions in Printing Processes", U.S. Appl. No. 14/502,202, filed Sep. 30, 2014.

Sisler, Gorden et al., Sacrificial Coating for Intermediate Transer of an Indirect Printing Apparatus, U.S. Appl. No. 14/493,398, filed Sep. 23, 2014.

Song, et al., "Sacrificial Coating and Indirect Printing Apparatus Employing Sacrificial Coating on Intermediate Transfer Member", U.S. Appl. No. 14/665,319, filed Mar. 23, 2015.

Larson, et al., "Sacrificial Coating and Indirect Printing Apparatus Employing Sacrificial Coating on Intermediate Transfer Member", U.S. Appl. No. 14/830,557, filed Aug. 19, 2015.

Larson, et al., "Sacrificial Coating and Indirect Printing Apparatus Employing Sacrificial Coating on Intermediate Transfer Member", U.S. Appl. No. 14/867,864, filed Sep. 28, 2015.

http://www2.dupont.com/Elvanol/en_US/assets/downloads/elvanol_51_05.pdf, 2006.

DOW, DOW Surfacants, http://www.dow.com/surfacants/products/second.htm, retrieved Mar. 10, 2014, pp. 1-2.

Dow, Material Safety Data Sheet, TERGITOL(TM) TMN-6 (90% AQ), The Dow Chemical Company, Feb. 12, 2003, pp. 1-15.

Author Unknown, Byk-Silclean 3700 by BYK Chemie, http://www.specialchem4coatings.com/tds/byk-silclean-3700/byk-chemie/10414/index.aspx?q=Byk%20Silclean%203700, 2013, 1 page.

Author Unknown, Desmodur N 3790 BA, Bayer MaterialScience, LLC., http://www.bayermaterialsciencenafta.com/products/index.

(56) References Cited

OTHER PUBLICATIONS cfm?mode=lit&pp_num=EB7C52DD-F4EC-BDA1-6BE0225FEE5C1FDO&pg_num=EB7C5520-9065-98A0-5A4CD71113D57191&pf=0&pf=1, 2007, 1 page.
Law et al., "Self Cleaning Polymers and Surfaces", TechConnect World Conference & Expo, Jun. 13-16, 2011, abstract of presentation, 1 pages.
Author Unknown, "Products and Properties: Desmodur/Desmophen for Coatings, Commerical Products", Bayer MaterialScience AG brochure, Edition: Jul. 2005 E, 28 pages.
DOW, Product Safety Assessment, TRITON CF Series Surfactants, Dec. 16, 2012, 6 pages.
Wikipedia, Hydrocarbon, Downloaded Mar. 2, 2016, 8 pages.
Reddy et al., "Citric acid cross-linking of starch films," University of Nebraska—Lincoln, Faculty Publications—Textiles, Merchandising and Fashion Design, Paper 25, 2009, pp. 702-711.
Wikipedia, "Tricarboxylic Acid," 2 pages printed on Aug. 19, 2015.
Wikipedia, "Dicarboxylic Acid," 7 pages printed on Aug. 19, 2015.
Wikipedia, "Tetracarboxylic acids", 2 pages printed on Aug. 19, 2015, https://commons.wikimedia.org/wiki/Category:Tetracarboxylic_acids.
Berset 2185, Technical Data Sheet, Mar. 14, 2012, 2 pages.
Wang, et al., "Preparation of a Crosslinking Cassava Starch Adhesive and its Application in Coating Paper", BioResources, 2013, 8 (3), pp. 3574-3589.
Philipp, et al., "Three Methods for In Situ Cross-Linking of Polyvinyl Alcohol Films for Application as Ion-Conducting Membranes in Potassium Hydroxide Electrolyte", NASA, Apr. 1979,18 pages.
Song, "Starch crosslinking for cellulose fiber modification and starch nanoparticle formation", https://smarttech.gatech.edu/handle/1853/39524?show=full, downloaded Jan. 22, 2015, 4 pages.
Cabot, "Speciatly Carbon Blacks for Ultraviolet Protection & Weatherability", Cabot Corporation, 2 pages.
Author Unknown, "Dot Tool", Quality Engineering Associates, Inc., pp. 1-3.
Ming-Kai Tse, "PIAS-II TM—A Hig-performance Portable tool for Print Quality Analysis Anytime, Anywhere", Quality Engineering Associates (QEA), Inc. pp. 1-4.
Allen, et al., "Acrylate Ink Compositions for Ink-Based Digital Lithographic Printing", U.S. Appl. No. 14/645,153, filed Mar. 11, 2015.
Breton, et al., "Process Black Ink Compositions and Uses Thereof", U.S. Appl. No. 14/635,679, filed Mar. 2, 2015.
Communication dated May 4, 2015, issued in EP Appl. No. 14196839.6, pp. 1-5.
Henri Bouas-Laurent, et al., Organic Photochromism (IUPAC Technical Report), Pure Appl. Chem., vol. 73, No. 4, pp. 639-665, 2001.
Leach, et al., "The Printing Ink Manual, 5th Edition", Blue Print, New York, pp. 84-86, 516, 525, 544-550, 724-726 (1993).
Thesis of Enrique Michel-Sanchez, Impact of Particle Morphology on the Rheology of PCC-Based Coatings, Aug. 2005.
Stowe, et al., "Methods for Rejuvenating an Imaging Member of an Ink-Based Digital Printing System", U.S. Appl. No. 15/240,691, filed Aug. 18, 2016.
Badesha, et al. "Fluorosilicone composite and Formulation Process for Imaging Plate", U.S. Appl. No. 15/222,364, filed Jul. 28, 2016.
Bruce E. Kahn, "The M3D Aerosol Jet System, An Alternative to Inkjet Printing for Printed Electronics", Organic and Printed Electronics, vol. 1, Issue 1, Winter 2007, pp. 14-17.
Jikei et al., "Synthesis and Properties of Hyperbranched Aromatic Polyamide Copolymers from AB and AB2 Monomers by Direct Polycondensation", Macromolecules 2000, 33, pp. 6228-6234.
Sisler, Gorden et al., Method of Making Sacrificial Coating for an Intermediate Transfer Member of Indirect Printing Apparatus, U.S. Appl. No. 15/421,929, filed Feb. 1, 2017.
Birau, et al. "Ink Composition and Method of Printing", U.S. Appl. No. 15/377,881, filed Dec. 13, 2016.
Sisler, Gordon et al. "Sacrificial Coating for Intermediate Transfer Member of an Indirect Printing Apparatus", U.S. Appl. No. 15/369,962, filed Dec. 6, 2016.
Sisler, Gordon et al. "Sacrificial Coating for Intermediate Transfer Member of an Indirect Printing Apparatus", U.S. Appl. No. 15/410,050, filed Jan. 19, 2017.
Allen, et al., "Acrylate Ink Compositions for Ink-Based Digital Lithographic Printing", U.S. Appl. No. 15/435,098, filed Feb. 16, 2017.
Breton, et al. "Aqueous Dispersible Polymer Inks", U.S. Appl. 15/442,260, filed Feb. 24, 2017.

* cited by examiner

MULTILAYER IMAGING BLANKET COATING

DETAILED DESCRIPTION

Field of the Disclosure

The present teachings relate to printers and, more particularly, to a multilayer imaging blanket for use in printing systems.

Background

Various types of printing systems employ blankets on which an image is formed prior to transfer of the image to the final substrate. The combined chemical, mechanical and thermal properties of these blankets for modern printing processes can be demanding.

To ensure excellent print quality it is desirable that the surface properties (e.g., wettability and surface energy) of the blanket promote good image formation on the blanket and transfer of the print image from the blanket to the print media substrate (e.g., paper). The mechanical properties of the blanket can also promote or hinder good quality of print. One mechanical factor in providing good print quality is the conformance the blanket provides between the blanket surface and the print media substrate. Poor conformance can result in poor ink transfer, and thus poor image quality. Further, the inability of the blanket to properly manage heat during the process, such as by retaining heat on the blanket surface for drying the ink and transferring sufficient heat away from the blanket for suitable cooling between cycles, can be problematic.

Therefore, novel blanket configurations for printer blankets that can help solve one or more of the above mentioned problems would be a welcome addition in the art.

SUMMARY

An embodiment of the present disclosure is directed to a multilayer imaging blanket. The multilayer imaging blanket comprises a seamless belt. A silicone layer is disposed on the belt. The silicone layer comprises silicone rubber and a metal oxide filler. A fluoroelastomer surface layer is disposed on the silicone layer.

Another embodiment of the present disclosure is directed to an indirect printing apparatus. The apparatus comprises an image transfer member comprising a multilayer imaging blanket. The multilayer imaging blanket comprises a seamless belt; a silicone layer disposed on the belt, the silicone layer comprising silicone rubber and a metal oxide filler; and a fluoroelastomer surface layer disposed on the silicone layer. The apparatus further comprises a coating mechanism for forming a sacrificial coating onto the image transfer member; a drying station for drying the sacrificial coating; at least one ink jet nozzle positioned proximate the image transfer member and configured for jetting ink droplets onto the sacrificial coating formed on the image transfer member; an ink processing station comprising a radiation source for at least partially drying the ink on the sacrificial coating formed on the image transfer member; and a substrate transfer mechanism for moving a substrate into contact with the image transfer member.

Another embodiment of the present disclosure is directed to a printing apparatus. The printing apparatus comprises an image transfer member comprising a multilayer imaging blanket. The multilayer imaging blanket comprises a seamless belt; a silicone layer disposed on the belt, the silicone layer comprising silicone rubber and a metal oxide filler; and a fluoroelastomer surface layer disposed on the silicone layer. The printing apparatus further comprises a coating mechanism for applying a dampening fluid onto the image transfer member; an optical patterning subsystem configured to selectively apply energy to portions of the layer to image-wise evaporate the dampening fluid and create a latent negative of the ink image that is desired to be printed on the receiving substrate; an inker subsystem for applying ink composition to the image areas to form an ink image; a rheology control subsystem for partially curing the ink image; and a substrate transfer mechanism for moving a substrate into contact with the ink image.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrates embodiments of the present teachings and together with the description, serve to explain the principles of the present teachings.

Figure 1:
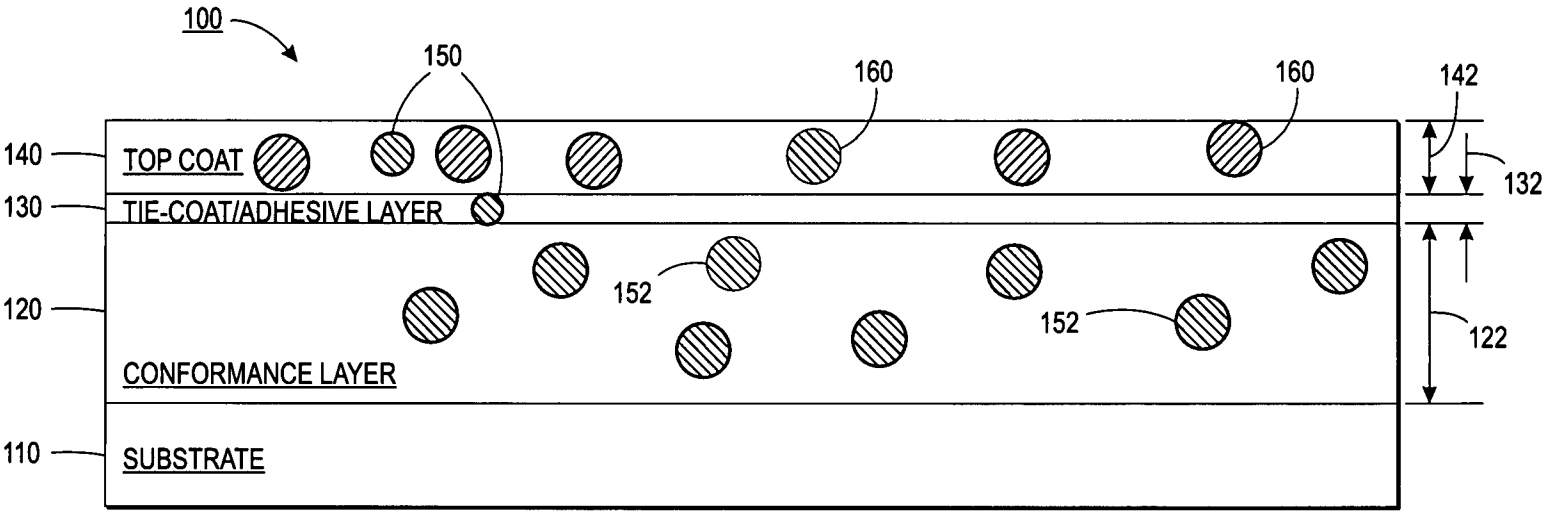
FIG. 1 depicts a schematic cross-sectional view of an illustrative multilayer imaging blanket for a printer, according to an embodiment of the present disclosure.

It should be noted that some details of the figure have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. In the drawings, like reference numerals have been used throughout to designate identical elements. In the following description, reference is made to the accompanying drawings that form a part thereof, and in which is shown by way of illustration a specific exemplary embodiment in which the present teachings may be practiced. The following description is, therefore, merely exemplary.

Multilayer Imaging Blanket

FIG. 1 depicts a schematic cross-sectional view of an illustrative multilayer imaging blanket 100 for a printer, according to an embodiment of the present disclosure. A potential advantage of a multilayer blanket configuration is the ability to fine tune the properties of the topcoat and the underlayer silicone and divide the functions between the layers for the improved overall performance of the blanket.

Substrate

The multilayer imaging blanket 100 may include a substrate 110 that provides support for the other layers of the blanket. The substrate can be a seamless belt, as is well known in the art. Seamless belts can provide advantages, such as, for example, improved motion quality of the blanket. The substrate 110 can be made of any suitable materials. Examples include polymers, such as polyimide, silicone or biaxially-oriented polyethylene terephthalate (e.g., MYLAR), woven fabric or combinations thereof. In an embodiment, the seamless belt is a freestanding polyimide film.

The substrate 110 can have any suitable thickness and the appropriate thickness may depend on the substrate material employed, among other things. Examples of thicknesses range from about 10 microns to about 1000 microns, such as about 20 or 30 microns to about 80, 100 or 200 microns.

Conformance Layer

A conformance layer 120 may be disposed on the substrate 110. The conformance layer 120 comprises a silicone rubber and a metal oxide filler 152. The silicone can add sufficient conformance ability to the printing surface of the blanket for improved transfer of the ink image to the media. The amount of metal oxide can be adjusted to tune the conformance of the blanket.

The insulating property of the silicone may also allow the surface layer to efficiently absorb and retain heat energy for drying of the ink. If fountain solution is employed in the printing process, such as may be used in an offset printing process, the heat energy at the surface of the blanket can aid in dissipating the fountain solution from the image areas in which ink is to be applied. The combination of silicone and metal oxide filler can provide sufficient heat transfer properties to allow sufficient cooling of the blanket between cycles. Metal oxide can also be added to tune the thermal insulating properties of the blanket. For example, silica can increase the thermal insulating ability of the silicone layer, which can be a desired property of the blanket in, for example, aqueous inkjet processes.

The term "silicone" is well understood in the arts and refers to polyorganosiloxanes having a backbone formed from silicon and oxygen atoms and side chains containing carbon and hydrogen atoms. In an embodiment, the silicone does not contain fluorine atoms. Other functional groups may be present in the silicone rubber, for example vinyl, nitrogen-containing, mercapto, hydride, and silanol groups, which are used to link siloxane chains together during crosslinking. The sidechains of the polyorganosiloxane can be alkyl or aryl.

The term "alkyl" as used herein refers to a radical that is composed entirely of carbon atoms and hydrogen atoms and that is fully saturated. The alkyl radical may be linear, branched, or cyclic. Linear alkyl radicals generally have the formula $—C_nH_{2n+1}$.

The term "aryl" refers to an aromatic radical composed entirely of carbon atoms and hydrogen atoms. When aryl is described in connection with a numerical range of carbon atoms, it should not be construed as including substituted aromatic radicals. For example, the phrase "aryl containing from 6 to 10 carbon atoms" should be construed as referring to a phenyl group (6 carbon atoms) or a naphthyl group (10 carbon atoms) only, and should not be construed as including a methylphenyl group (7 carbon atoms).

In an embodiment, the silicone rubber is solution or dispersion coatable, which permits easy fabrication of the silicone layer. In addition, the silicone rubber may be room temperature vulcanizable, which can be accomplished, for example, by using a platinum catalyst or other suitable catalyst for curing. In an example, the silicone rubber is formed from a poly(dimethyl siloxane) that contains functional groups, such as vinyl or hydride, which permit addition crosslinking. Such silicone rubbers are commercially available, for example as ELASTOSIL RT 622 from Wacker.

As discussed above, the silicone rubber can include one or more metal oxide fillers 152, such as iron oxide (FeO) or silica. For purposes of this disclosure, metal oxide is defined to include oxides of both metals and metalloids, such as silica. As also discussed above, the amount of metal oxide filler can be adjusted to tune at least one of the conformance property of the blanket or the insulating properties of the blanket. Any suitable amount of metal oxide filler that will provide the desired conformance and/or thermal properties can be employed. For example, the metal oxide filler may make up from about 5 to about 20 weight percent of the conformance layer, such as about 7 to about 15 weight percent. The silicone rubber may make up from about 80 to about 95 weight percent of the conformance layer, such as about 85 to about 93 weight percent.

The conformance layer 120 may have any suitable thickness. Example thicknesses 122 ranging from about 200 μm to about 6000 μm, about 500 μm to about 4000 μm, or about 500 μm to about 2000 μm.

Optional Adhesive Layer

An optional adhesive layer 130 may be disposed on the conformance layer 120. The adhesive layer 130 may have any suitable thickness, such as, for example, a thickness 132 ranging from about 0.05 μm to about 10 μm, about 0.25 μm to about 5 μm, or about 0.5 μm to about 2 μm. The adhesive layer 130 may be made from a silane, an epoxy silane, an amino silane adhesive, or a combination thereof. In another embodiment, the adhesive layer 130 may be made from a composite material. More particularly, the adhesive layer 130 may be made from or include a polymer matrix. The polymer matrix may be or include silicone, a crosslinked silane, or a combination thereof.

Topcoat Layer

A topcoat layer (also referred to herein as a "surface layer") 140, may be disposed on the optional adhesive layer 130 and/or conformance layer 120. The topcoat layer 140 can be a fluoroelastomer, such as a fluoroelastomer-aminosilane grafted polymer composition or a fluorosilicone.

Fluoroelastomer-Aminosilane Grafted Polymer Topcoat

The topcoat layer 140 can provide one or more of the following beneficial properties: suitable wetting and/or spreading of the ink or skin (in the case of aqueous ink transfix process); suitable drying of the ink or skin at relatively low power; and good transfer properties of the ink image and/or skin to the print media.

In an embodiment, the surface layer 140 comprises a fluoroelastomer-aminosilane grafted polymer composition. The composition is made by (i) mixing ingredients comprising a fluoroelastomer; an aminosilane; a solvent; and an infrared absorptive filler material to form a coating composition, (ii) depositing the coating composition onto the substrate; and (iii) curing the coating composition.

Any suitable fluoroelastomer can be employed in the fluoroelastomer-aminosilane grafted polymer composition. In an embodiment, the fluoroelastomer is a co-monomer that includes a vinylidene fluoride monomer unit and has substituent fluoro, alkyl, perfluoroalkyl, and/or perfuoroalkoxy groups on the polymer chain. The term copolymer here refers to polymers made from two or more monomers. In an embodiment, the fluorelastomers are categorized under the ASTM D1418, and have the ISO 1629 designation FKM. This class of elastomer is a family comprising copolymers that contains monomer units exclusively selected from the group consisting of hexafluoropropylene (HFP), tetrafluoroethylene (TFE), vinylidene fluoride (VDF), perfluoromethyl vinyl ether (PMVE), and ethylene (ET). In an embodiment, the fluoroelastomers may contain two or three or more of these monomers, and have a fluorine content of from about 60 wt % to about 70 wt %.

In an embodiment, the fluoroelastomer in the fluoroelastomer-aminosilane grafted polymer composition is a copolymer of vinylidene fluoride, hexafluoropropylene and tetrafluoroethylene. Exemplary commercially available fluoroelastomers include the TECNOFLON brand P959 from Solvay America, Inc. (Houston, Tex.) or as a VDF-TFE-HFP terpolymer under the DAI-EL brand G621 from Daikin Industries (Houston, Tex.).

The aminosilane is used as a crosslinker. Any suitable aminosilane that can provide the desired cross-linking of the fluoroelastomer may be employed. An exemplary aminosilane compound that can be reacted with the fluoroelastomer is an oxyaminosilane. The term "oxyaminosilane" refers to a compound that has at least one silicon atom covalently bonded to an oxygen atom and that has at least one amino group (—$NH_2$). The oxygen atom may be part of a hydrolyzable group, such as an alkoxy or hydroxyl group. The amino group is not necessarily covalently bonded to the silicon atom, but may be joined through a linking group. A general formula for an oxyaminosilane is provided in Formula (2):

$$Si(OR)_pR'_q(\text{-}L\text{-}NH_2)_{4-p-q} \qquad \text{Formula (1)}$$

where R and R' can be the same or different and are selected from hydrogen or an alkyl; p is an integer from 1 to 3; q is an integer from 0 to 2; and L is a linking group, such as an alkylamine or alkyl linking group. More desirably, p is 2 or 3. The sum of 4-p-q is at least 1. The term "alkoxy" refers to an alkyl radical (usually linear or branched) bonded to an oxygen atom, e.g. having the formula —$OC_nH_{2n+1}$.

In an embodiment, the oxyaminosilane is an aminosubstituted trialkoxysilane, such as a trimethoxysilane or a triethoxysilane. In an embodiment, the oxyaminosilane can be aminosubstituted dialkoxy-alkyl silanes, such as an aminosubstituted dimethoxy-methyl silane. Exemplary oxyaminosilanes include [3-(2-aminoethylamino)propyl] trimethoxysilane and 3-aminopropyl trimethoxysilane. In 3-aminopropyl trimethoxysilane, the propyl chain is the linking group. Such silanes are commercially available, for example from Sigma-Aldrich or UCT (sold as AO700). The amine functional group may be a primary, secondary, or tertiary amine. The nitrogen atom of an amino group can bond with the fluoroelastomer and thus, in at least some cases, the oxygen atom does not bond with the fluoroelastomer.

One or more optional co-crosslinkers could be employed in addition to the aminosilane crosslinker in order to tailor the surface properties of the fluoroelastomer, if desired. For example, the fluoroelastomer can optionally be co-cross-linked with an aminofunctionalized silane having one or more fluoroalkyl substituents. Examples of suitable aminofunctionalized silane co-crosslinkers are disclosed U.S. Pat. No. 9,353,290, the disclosure of which is hereby incorporated by reference in its entirety.

One or more infrared absorptive filler materials 160 such as carbon black, graphene, carbon nanotubes, iron oxide, or a combination thereof, are included in the topcoat layer 140. Among other things, the infrared absorptive filler materials may reduce a temperature differential that can exist between different colored inks during radiative drying on the multilayer imaging blanket 100.

The infrared absorptive filler materials may be present in the topcoat layer 140 in an amount ranging from about 0.1 wt % to about 20 wt %, about 1 wt % to about 15 wt %, or about 2 wt % to about 10 wt %, relative to the total weight of the topcoat layer. Other examples include ranges of from about 1% by weight to about 5% by weight, or about 3% by weight, based on the total weight of the topcoat layer 140.

The topcoat layer 140 may further include one or more infrared reflective pigments 150. In another embodiment, the conformance layer 120, the adhesive layer 130, the topcoat layer 140, or a combination thereof may include the reflective pigments 150. The reflective pigments 150 in the topcoat layer 130 may be the same as the reflective pigments 150 in the conformance layer 120 and/or the adhesive layer 130, or they may be different. For example, the reflective pigments 150 in the topcoat layer 140 may be or include titanium dioxide, silica nickel rutile, chromium rutile, cobalt-based spinel, chromium oxide, chrome iron nickel black spinel, or a combination thereof. The reflective pigments 150 may be present in the topcoat layer 140 in an amount ranging from about 0.1 wt % to about 20 wt %, about 1 wt % to about 15 wt %, or about 2 wt % to about 10 wt %. In an embodiment, reflective pigments are not included in the conformance layer. In another embodiment, reflective pigments are not included in any of the conformance, adhesive or topcoat layers.

The incorporation of the reflective pigments 150 into the topcoat layer 140 may improve the reflection of radiant energy back into the ink for absorption by the ink components for improved and/or enhanced ink drying. When the reflective pigments 150 are combined in the topcoat layer 140 with the absorptive materials 160, such as carbon black, the efficiency of photothermal conversion may be enhanced relative to carbon black alone. Further, the differential rate of drying among different ink colors may be reduced or eliminated. The amount of radiant energy waste may be reduced, and the efficiency of the ink drying may improve.

The topcoat layer 140 can have any desired thickness. As an example, the topcoat layer 140 may have a depth or thickness 142 ranging from about 5 μm to about 500 μm, about 20 μm to about 200 μm, about 30 μm to about 100 μm, or about 30 μm to about 70 μm.

The topcoat layer 140 of the present disclosure can be made by any suitable polymerization process. For example, a desired amount of infrared absorptive filler can be well mixed with the fluoroelastomer and a suitable solvent. The aminosilane dissolved in a solvent can then be added to the fluoroelastomer/filler mixture in an amount sufficient to provide the desired cross linking during the curing process. Catalysts can optionally be employed to promote polymerization and/or cross-linking during curing. In embodiments, an amount of the aminofunctionalized silane is in a range from about 2 pph to about 10 pph, relative to the fluoroelastomer. After mixing the aminosilane and fluoroelastomer/filler mixtures, the resulting liquid coating formulation can be coated onto a suitable substrate and cured, as discussed in greater detail below. The crosslinked coating prepared according to the instant disclosure can withstand high temperature conditions without melting or degradation, is mechanically robust under such conditions and provides good wettability.

Solvents used for processing of precursors and coating of layers include organic hydrocarbon solvents, alcohols such as methanol, ethanol, isopropanol, and n-butanol and fluorinated solvents. Further examples of solvents include ketones such as methyl ethyl ketone, and methyl isobutyl ketone ("MIBK"). Mixtures of solvents may be used. In embodiments, the solvent may be present in an amount of at least 20 weight percent of the formulation composition, such as from about 20 weight percent to about 90 weight percent, or from about 50 weight percent to about 80 weight percent of the formulation composition.

The liquid coating compositions formed can include any suitable amount of coating precursors and solvent. In an embodiment, solids loading of the composition can range from about 10 weight percent to about 80 weight percent, such as from about 18 or 20 weight percent to about 70 weight percent, or from about 40 weight percent to about 60 weight percent.

In embodiments, the liquid coating formulation may be applied to a substrate using any suitable liquid deposition technique. Exemplary methods for depositing the coating solution on the substrate include draw-down coating, spray coating, spin coating, flow coating, dipping, spraying such as by multiple spray applications of very fine thin films, casting, web-coating, roll-coating, extrusion molding, laminating, or the like. The thickness of the coating solution may be from about 1000 nm to about 200 μm, such as from about 5000 nm to about 100 μm, or from about 30 μm to about 100 μm.

Following coating of the liquid formulation onto a substrate, a cured film may be formed upon standing or from drying with heat treatment. The curing processes according to the instant disclosure may be carried out at any suitable temperature, such as from about 80° C. to about 200° C., or from about 100° C. to about 180° C., or from about 120° C. to about 160° C. The curing process can occur for any suitable length of time to provide the desired cross-linking and removal of solvent.

The top coat layer 140 can be tailored to best support the requirements of the aqueous transfix process in which the top coat layer is employed. For example, the top coat layer can have properties that both promote uniform wetting (good-spread) of a sacrificial layer (sometimes referred to as a "skin"), which is discussed in detail below, as well as exhibit sufficient release properties to ensure the sacrificial layer/ink image is transferred efficiently to the final print media. Further, the topcoat layer can absorb the radiant energy from the drying lamps to compensate for any differences in ink absorption. That is, uniform heating of the larger thermal mass top coat layer can act to equilibrate differences in ink temperature. Improvements in ink temperature uniformity may provide improved color-to-color transfer consistency in an aqueous transfix printing process.

Fluorosilicone Topcoat

A fluorosilicone layer can be employed as the topcoat layer 140. A fluorosilicone topcoat can be used in various applications, such as, for example, in offset printing, as described in U.S. Patent Application Publication No. 2014/0060359 by Mandakini Kanungo, et al., the disclosure of which is hereby incorporated by reference in its entirety.

In offset printing processes, the surface of the topcoat can have a micro-roughened surface structure to help retain fountain solution/dampening fluid in the non-image areas. These hillocks and pits that make up the surface enhance the static or dynamic surface energy forces that attract the fountain solution to the surface. This reduces the tendency of the fountain solution to be forced away from the surface by roller nip action. The imaging member plays multiple roles in the variable data lithography printing process, which include: (1) wetting with the fountain solution, (2) creation of the latent image, (3) inking with the offset ink, and (4) enabling the ink to lift off and be transferred to the receiving substrate. Some desirable qualities for the imaging member, particularly its surface, include high tensile strength to increase the useful service lifetime of the imaging member. The surface layer can also weakly adhere to the ink, yet be wettable with the ink, to promote both uniform inking of image areas and to promote subsequent transfer of the ink from the surface to the receiving substrate. Finally, some solvents have such a low molecular weight that they inevitably cause some swelling of the imaging member surface layer. Wear can proceed indirectly under these swell conditions by causing the release of near infrared laser energy-absorbing particles at the imaging member surface, which then act as abrasive particles. Desirably, the imaging member surface layer has a low tendency to be penetrated by solvent.

In an embodiment, the topcoat 140 of the present disclosure includes a fluorosilicone and an infrared-absorbing filler. The term "fluorosilicone" as used herein refers to polyorganosiloxanes having a backbone formed from silicon and oxygen atoms and sidechains containing carbon, hydrogen, and fluorine atoms. At least one fluorine atom is present in the sidechain. The sidechains can be linear, branched, cyclic, or aromatic. The fluorosilicone may also contain functional groups, such as amino groups, which permit addition crosslinking. When the crosslinking is complete, such groups become part of the backbone of the overall fluorosilicone. Suitable fluorosilicones are commercially available, such as for example CF1-3510 from NuSil or vinyl terminated trifluoropropyl methylsiloxane polymers available from Wacker under the tradename SLM 50330 or fluorosilicone from Momentive.

Any suitable amount of fluorine that provides desired release properties and/or surface energy properties can be employed. In an embodiment, at least 25%, such as at least 35%, or at least 40% or at least 75% of the siloxane units of the fluorosilicone are fluorinated. The percentage of fluorinated siloxane units can be determined by considering that each silicon atom contains two possible sidechains. The percentage is calculated as the number of sidechains having at least one fluorine atom divided by the total number of sidechains (i.e. twice the number of silicon atoms).

In an embodiment, the fluorosilicones can be formed using a fluorosilicone reactant and a crosslinker. The fluorosilicone reactant can include a mixture of alkyl and fluoroalkyl side chains. For example, fluorosilicone reactant may include a proportion of methyl side chains and a proportion of trifluoropropyl sidechains. One example of such a fluorosilicone reactant is a vinyl terminated trifluoropropyl methylsiloxane polymer, such as the commercially available vinyl terminated trifluoropropyl methylsiloxane polymers available from Wacker under the tradename SLM, as mentioned above. One example of the SLM compound is represented by Formula 2 below, where X can be any suitable number of siloxane repeating units. In an embodiment, X can range from about 20 to about 40, such as about 25 to about 35, or about 27.

Formula (2)

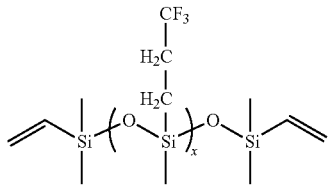

A variety of crosslinker molecules can be employed, including substituted or unsubstituted compounds having a polysiloxane backbone comprising one or more hydrogens attached to the silicon atoms of the polysiloxane chain. Substituents can include alkyl groups and fluoroalkyl groups attached to the silicone atoms of the polysiloxane backbone. One example is a polysiloxane comprising at least one, such as two to ten, fluoroalkyl substituted siloxane repeating units and at least one, such as two to ten, internal siloxane repeating unit with an Si—H bond, such as the crosslinking compound of Formula 3 below.

Formula (3)

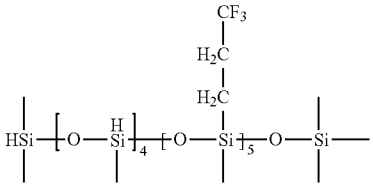

The fluorosilicone reactant and crosslinker can be mixed and cured. Curing may be carried out by any suitable technique, such as with moisture and/or with a catalyst. One example is addition curing techniques using a platinum catalyst in which the vinyl groups of the fluorosilicone reactant covalently bonds with Si—H groups of the crosslinker. Salts or complexes of platinum can serve as the catalyst. One example of a platinum catalyst-cyclic siloxane complex is shown below as Formula 4. Various other platinum catalyst complexes and salts are known in the art.

Formula (4)

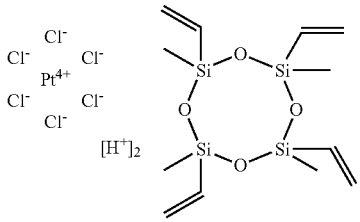

Various fillers can be employed in the fluorosilicone topcoat. In an embodiment, infrared-absorbing filler is used. The infrared-absorbing filler is able to absorb energy from the infra-red portion of the spectrum (having a wavelength of from about 750 nm to about 1000 nm). This aids in efficient evaporation of the fountain solution used in off-set printing processes. In embodiments, the infrared-absorbing filler may be one or more of carbon black, a metal oxide such as iron oxide (FeO), carbon nanotubes, graphene, graphite, or carbon fibers. The filler may have any suitable average particle size, such as from about 2 nanometers to about 10 microns.

In an embodiment, the infrared-absorbing filler may make up from about 5 to about 30 weight percent of the surface layer, including from about 10 to about 25 weight percent. In an embodiment, the fluoroelastomer may make up from about 70 to about 95 weight percent of the surface layer, including from about 75 to about 90 weight percent.

If desired, the surface layer may also include other fillers, such as silica. Silica can help increase the tensile strength of the surface layer and increase wear resistance. Silica can also be added to improve the flow of the solution for flow coating and has also shown to help in the dispersion of carbon black. In an embodiment, 5% by weight or less of the silica is employed, such as from about 1% to about 5% or about 2% to about 4% by weight. In other embodiments, such as where silica is used to increase tensile strength or wear resistance, silica may be present in an amount of from about 2 to about 30 weight percent of the surface layer, including from about 5 to about 30 weight percent.

The fluorosilicone topcoat layer may have any suitable thickness. For example, the thickness of the coating solution may be from about 100 nm to about 5000 μm, such as from about 500 nm to about 500 μm, or from about 30 μm to about 100 μm. In an embodiment, the thickness ranges from about 0.5 microns (μm) to about 4 millimeters (mm), depending on the requirements of the overall printing system.

Printers Employing Multilayer Imaging Blanket

Aqueous Inkjet Transfix Printer

Figure 2:
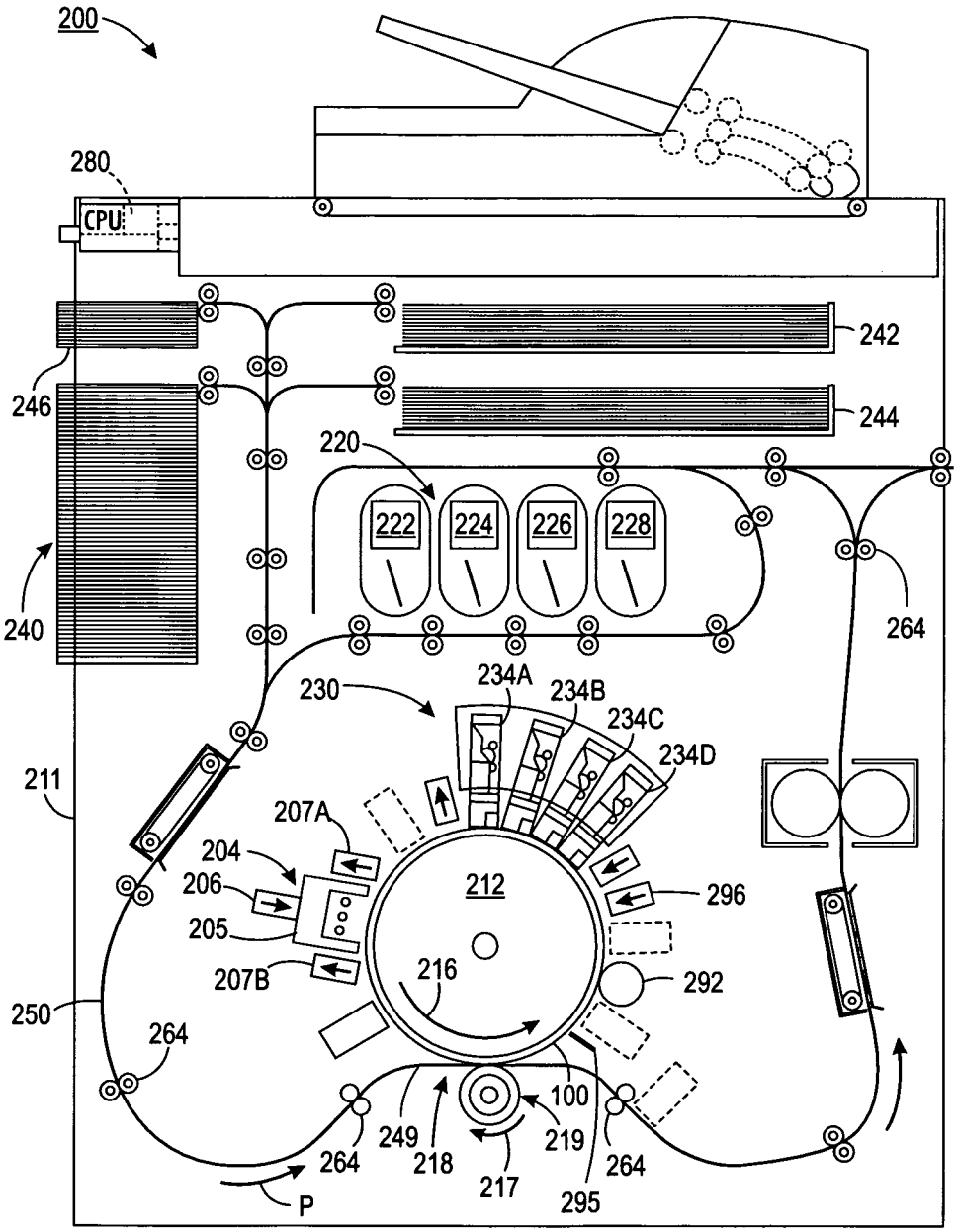
FIG. 2 illustrates an aqueous inkjet printer including a multilayer imaging blanket, according to an embodiment of the present disclosure.

FIG. 2 depicts a printer 200 including the multilayer imaging blanket 100, according to an embodiment of the present disclosure. The printer 200 may be an indirect aqueous inkjet printer that forms an ink image on a surface of the multilayer imaging blanket 100. Examples of aqueous inkjet printers are described in more detail in U.S. Pat. No. 9,126,430 and U.S. Pat. No. 9,303,185, the disclosures of both of which are herein incorporated by reference in their entireties.

The printer 200 includes a frame 211 that supports operating subsystems and components, which are described below. The printer 200 includes an image transfer member, which is illustrated as comprising a rotating imaging drum 212 and a multilayer imaging blanket 100. Any of the multilayer imaging blankets described herein can be employed. In an embodiment, the multilayer imaging blanket 100 is in the form of a blanket that is manufactured separately and then mounted about the circumference of the drum 212.

The multilayer imaging blanket 100 may move in a direction 216 as the drum 212 rotates. The transfix roller 219 may rotate in the direction 217 and be loaded against the surface of multilayer imaging blanket 100 to form the transfix nip 218, within which ink images formed on the surface of multilayer imaging blanket 100 are transfixed onto a print medium 249. In some embodiments, a heater (not shown) in the drum 212 or in another location of the printer heats the multilayer imaging blanket 100 to a temperature in a range of, for example, approximately 50° C. to approximately 120° C. The elevated temperature promotes partial drying of the liquid carrier that is used to deposit the hydrophilic sacrificial coating composition and the water in the aqueous ink drops that are deposited on the multilayer imaging blanket 100.

A cleaning unit, such as a blade 295, may remove residual ink left on the surface of the multilayer imaging blanket 100 after the ink images are transferred to the print medium 249. A surface maintenance unit ("SMU") 292 may include a coating applicator, such as a donor roller (not shown), which is partially submerged in a reservoir (not shown) that holds the hydrophilic sacrificial coating composition in a liquid carrier. The donor roller may draw the liquid sacrificial coating composition from the reservoir and deposit a layer of the sacrificial coating composition on the multilayer imaging blanket 100. After a drying process, which can be carried out, for example, by a dryer 296, the dried sacrificial coating may substantially cover a surface of the multilayer imaging blanket 100 before the printer 200 ejects ink drops during a print process.

The printer 200 may also include an aqueous ink supply and delivery subsystem 220 that has at least one source 222 of one color of aqueous ink. In an embodiment, the printer 200 is a multicolor image producing machine, the ink delivery system 220 including, for example, four (4) sources 222, 224, 226, 228, representing four (4) different colors CYMK (cyan, yellow, magenta, black) of aqueous inks.

A printhead system 230 may include a printhead support, which provides support for a plurality of printhead modules, also known as print box units, 234A-234D. Each printhead module 234A-234D effectively extends across a width of the multilayer imaging blanket 100 and ejects ink drops onto the multilayer imaging blanket 100. A printhead module 234A-234D may include a single printhead or a plurality of printheads configured in a staggered arrangement. The printhead modules 234A-234D may include associated electronics, ink reservoirs, and ink conduits to supply ink to the one or more printheads, as would be understood by one of ordinary skill in the art.

After the printed image on the multilayer imaging blanket 100 exits the print zone, the image passes under an image dryer 204. The image dryer 204 may include a heater 205, such as a radiant infrared heater, a radiant near infrared heater, and/or a forced hot air convection heater. The image dryer 204 may also include a dryer 206, which is illustrated as a heated air source, and air returns 207A and 207B. The heater 205 may apply, for example, infrared heat to the printed image on the surface of the multilayer imaging blanket 100 to evaporate water and/or solvent in the ink. The heated air source 206 may direct heated air over the ink to supplement the evaporation of the water and/or solvent from the ink. In an embodiment, the dryer 206 may be a heated air source with the same design as the dryer 296. While the dryer 296 may be positioned along the process direction to dry the hydrophilic sacrificial coating, the dryer 206 may also be positioned along the process direction after the printhead modules 234A-234D to at least partially dry the aqueous ink on the multilayer imaging blanket 100. The air may then be collected and evacuated by air returns 207A and 207B to reduce the interference of the air flow with other components in the printing area.

The printer 200 may further include a print medium supply and handling system 240 that stores, for example, one or more stacks of paper print mediums of various sizes, as well as various other components useful for handling and transferring the print medium. While example handling and transfer components are illustrated at 242, 244, 246, 250 and 264, any suitable supply and handling system can be employed, as would be readily understood by one of ordinary skill in the art. Operation and control of the various subsystems, components, and functions of the printer 200 may be performed with the aid of the controller 280. In an embodiment, the controller 280 may be the main multitasking processor for operating and controlling all of the other machine subsystems and functions.

Once an image or images have been formed on the multilayer imaging blanket 100 and the sacrificial coating, components within the printer 200 may operate to perform a process for transferring and fixing the image or images from the multilayer imaging blanket 100 to media. For example, heat and/or pressure can be applied by the transfix roller 219 to the back side of the heated print medium 249 to facilitate the transfixing (transfer and fixing) of the image from the image transfer member onto the print medium 249. In an embodiment, the sacrificial coating is also transferred from the image transfer member to the print medium 249 as part of the transfixing process.

After the image transfer member moves through the transfix nip 218, the image receiving surface passes a cleaning unit that can remove any residual portions of the sacrificial coating and small amounts of residual ink from the image receiving surface of the multilayer imaging blanket 100.

Printer for Digital (Variable) Offset Printing Process

Figure 3:
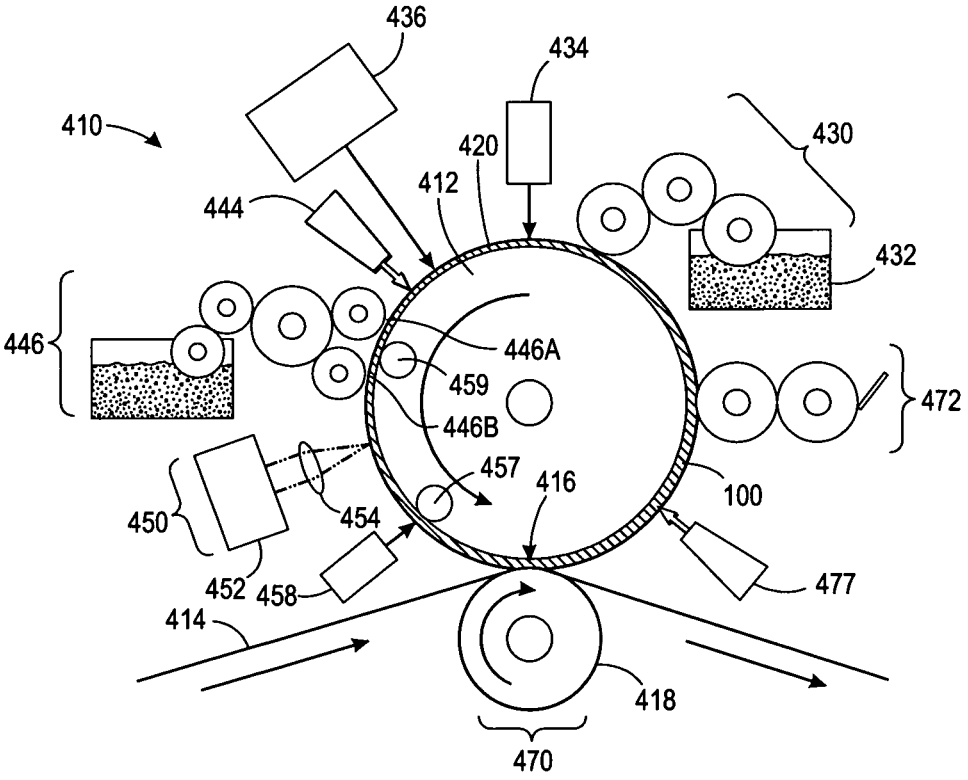
FIG. 3 illustrates a schematic view of a variable lithographic printing apparatus in which the multilayer imaging blankets of the present disclosure may be used, according to an embodiment of the present disclosure.

FIG. 3 illustrates a printer 410 for variable lithography in which a multilayer imaging blanket of the present disclosure may be used. The printer 410 includes an image transfer member, which is illustrated as comprising a rotating drum 412 and a multilayer imaging blanket 100. In an embodiment, the multilayer imaging blanket 100 comprises a seamless belt 110 (shown in FIG. 1); a silicone layer 120 disposed on the belt, and a fluoroelastomer surface layer 140 disposed on the silicone layer. In the printer 410, the fluoroelastomer topcoat layer 140 is a reimageable surface layer. In an embodiment, the surface layer 140 comprises a fluorosilicone. The surface layer is the outermost layer of the imaging member, i.e. the layer of the imaging member furthest from the belt substrate.

Any of the multilayer imaging blankets 100 described herein can be employed. In an embodiment, the multilayer imaging blanket 100 is in the form of a blanket that is manufactured separately and then mounted about the circumference of the drum 412.

In the depicted embodiment the imaging member rotates counterclockwise and starts with a clean surface. Disposed at a first location is a dampening fluid subsystem 430, which uniformly wets the surface with dampening fluid 432 to form a layer having a uniform and controlled thickness. Ideally the dampening fluid layer is between about 0.15 micrometers and about 1.0 micrometers in thickness, is uniform, and is without pinholes. As explained further below, the composition of the dampening fluid aids in leveling and layer thickness uniformity. A sensor 434, such as an in-situ non-contact laser gloss sensor or laser contrast sensor, is used to confirm the uniformity of the layer. Such a sensor can be used to automate the dampening fluid subsystem 430.

At optical patterning subsystem 436, the dampening fluid layer is exposed to an energy source (e.g. a laser) that selectively applies energy to portions of the layer to imagewise evaporate the dampening fluid and create a latent "negative" of the ink image that is desired to be printed on the receiving substrate. Image areas are created where ink is desired, and non-image areas are created where the dampening fluid remains. An optional air knife 444 is also shown here to control airflow over the surface layer 420 for the purpose of maintaining a clean dry air supply, a controlled air temperature, and for reducing dust contamination prior to inking. Next, an ink composition is applied to the imaging member using inker subsystem 446. Inker subsystem 446 may consist of a "keyless" system using an anilox roller to meter an offset ink composition onto one or more forming rollers 446A, 446B. The ink composition is applied to the image areas to form an ink image.

A rheology control subsystem 450 partially cures or tacks the ink image. This curing source may be, for example, an ultraviolet light emitting diode (UV-LED) 452, which can be focused as desired using optics 454. Another way of increasing the cohesion and viscosity employs cooling of the ink composition. This could be done, for example, by blowing cool air over the reimageable surface from jet 458 after the ink composition has been applied but before the ink composition is transferred to the final substrate. Alternatively, a heating element 459 could be used near the inker subsystem 446 to maintain a first temperature and a cooling element 457 could be used to maintain a cooler second temperature near the nip 416.

The ink image is then transferred to the target or receiving substrate 414 at transfer subsystem 470. This is accomplished by passing a recording medium or receiving substrate 414, such as paper, through the nip 416 between the impression roller 418 and the imaging member 412.

Finally, the imaging member should be cleaned of any residual ink or dampening fluid. Most of this residue can be easily removed quickly using an air knife 477 with sufficient air flow. Removal of any remaining ink can be accomplished at cleaning subsystem 472.

As used herein, unless otherwise specified, the word "printer" encompasses any apparatus that performs a print outputting function for any purpose, such as a digital copier, bookmaking machine, facsimile machine, a multi-function machine, electrostatographic device, etc.

Specific examples will now be described in detail. These examples are intended to be illustrative, and not limited to the materials, conditions, or process parameters set forth in these embodiments. All parts are percentages by solid weight unless otherwise indicated.

EXAMPLES

Example 1

Multilayer Blanket for Aqueous Inkjet Transfix Print Process

A 20-100 μm thick seamless polyimide (PI) film is mounted on a mandrel. A thin layer of Wacker G790 primer (vinyl terminated alkoxysilane) is applied on the surface of the PI film using a brush. No pretreatment of the PI film and no wiping of primer excess is required. The primer is applied for 1-2 h at room temperature and 40-60% humidity.

A Pt-cured siloxane RT622 formulation is prepared by combining: 9 mass parts of RT622 to 1 part of a silane crosslinker from Wacker Chemie AG of Munich Germany (premixed with Pt-catalyst and iron oxide particles) and 2 parts of MIBK. The final viscosity is around 5000 cPs. The formulation of RT622 is flow coated on the surface of the seamless PI functionalized with the primer. The thickness of RT 622 silicone is from about 0.5 mm to about 2 mm.

The RT 622 surface can be either roughened, treated with a primer or have an inline corona treatment that helps improve the adhesion of the FKM topcoat to the underlayer RT 622 silicone surface. The formulation of the topcoat includes mixing G621, aminosilane (AO700) curing agent and carbon black (N990) in MIBK. The thickness of the topcoat is about 30 μm to about 100 μm.

Example 2

Multilayer Blanket for Variable Lithography Print Process

A 20-80 μm thick seamless polyimide (PI) film is mounted on mandrel. A thin layer of Wacker G790 primer (vinyl terminated alkoxysilane) is applied on the surface of the PI film using a brush. No pretreatment of the PI film and no wiping of primer excess are required. The primer is applied for about 1 to about 2 h at room temperature and about 40 to about 60% humidity.

A Pt-cured siloxane RT622 formulation is prepared by combining: 9 mass parts of RT622 to 1 part of crosslinker (premixed with Pt-catalyst and iron oxide particles) and 4.5 parts of MIBK. The final viscosity is around 15000-20000 cPs. The formulation of RT622 is flow coated on the surface of the seamless PI functionalized with the primer.

The RT 622 surface can be either treated with a primer or have an inline corona treatment that helps improve the adhesion of a fluorosilicone topcoat to the underlayer RT 622 silicone surface. The topcoat fluorosilicone formulation is prepared by combining: 5 mass parts of SLM fluorosilicone from Wacker, (which is a vinyl terminated trifluoropropyl methylsiloxane polymer, where n=27); 1 part of crosslinker XL-150 from Nusil, 12.5 parts of trifluorotoluene (TFT) solvent; 20% carbon black (Emperor 1600 from Cabot), 1.15% Fumed Silica, 4.2 mL of Pt-catalyst (14.3% in TFT) per 100 g of FS.

In particular, the vinyl terminated trifluoropropyl methylsiloxane polymer is mixed with the carbon black, silica and trifluorotoluene (TFT) solvent in a paint shaker with stainless steel beads for 3 hours. Mixing in the paint shaker helps to disperse the carbon black finely in the fluorosilicone. After mixing, Pt catalyst is added and mixed well. The Crosslinker (XL-150) from Nusil is then added and mixed well. Viscosity of the formulation is adjusted to about 250 cP by addition of TFT. The formulation is degassed in vacuum to remove the air bubbles before flow coating. After flow coating, the flow coated blanket is post cured for 4 h at 160° C. All the materials are commercially available. The composition of an example formulation is as follows.

SLM(n=27)—100 g
Carbon Black (20% by weight)—30.4 g
Silica (1.15% by weight)—1.75 g
TFT—250 g
Pt catalyst (14.3% by weight in TFT)—4200 microliters
Part B (XL150 Crosslinker)—20 g
Viscosity: adjusted to a range of about 250 cP to about 280 cP Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompasses by the following claims.

What is claimed is:

1. A multilayer imaging blanket, comprising:

a seamless belt, wherein the belt is a freestanding polyimide film;

a silicone layer disposed on the belt, the silicone layer comprising silicone rubber and a metal oxide filler, wherein the silicone layer comprises a platinum cured siloxane; and a fluoroelastomer surface layer disposed on the silicone layer, where the fluoroelastomer surface layer is selected from the group consisting of (i) a fluoroelastomer-aminosilane grafted polymer composition and (ii) a fluorosilicone made by mixing a vinyl terminated trifluoropropyl methylsiloxane polymer with platinum catalyst and a crosslinker, the crosslinker being a substituted or unsubstituted polysiloxane chain having at least one internal siloxane repeating unit with an Si-H bond.

2. The blanket of claim 1, wherein the silicone rubber is present in the silicone layer in an amount ranging from about 80 to about 95 weight percent, based on the total weight of the silicone layer.

3. The blanket of claim 1, wherein the metal oxide filler is present in the silicone layer in an amount ranging from about 5 to about 20 weight percent, based on the total weight of the silicone layer.

4. The blanket of claim 1, wherein the metal oxide filler comprises a material selected from the group consisting of iron oxide particles, silica particles, and combinations thereof.

5. The blanket of claim 1, wherein the fluoroelastomer surface layer comprises a fluoroelastomer-aminosilane grafted polymer and infrared absorptive filler materials.

6. The blanket of claim 5, wherein a fluoroelastomer group of the fluoroelastomer-aminosilane grafted polymer contains two or more monomer units exclusively selected from the group consisting of hexafluoropropylene (HFP), tetrafluoroethylene (TFE), vinylidene fluoride (VDF), perfluoromethyl vinyl ether (PMVE) and ethylene (ET).

7. The blanket of claim 5, wherein an aminosilane group of the fluoroelastomer-aminosilane grafted polymer is an oxyaminosilane.

8. The blanket of claim 5, wherein an aminosilane group of the fluoroelastomer-aminosilane grafted polymer is an inosubstituted trialkoxysilane unit.

9. The blanket of claim 5, wherein the infrared absorptive filler materials of the fluoroelastomer surface layer comprise carbon black and the amount of carbon black ranges from about 1% by weight to about 5% by weight, based on the total weight of the fluoroelastomer surface layer.

10. The blanket of claim 5, wherein an aminosilane group of the fluoroelastomer-aminosilane grafted polymer is selected from the group consisting of a [3-(2-aminoethylamino)propyl] trimethoxysilane group and 3-aminopropyl trimethoxysilane group.

11. The blanket of claim 1, wherein the fluoroelastomer surface layer comprises fluorosilicone.

12. An indirect printing apparatus comprising:

an image transfer member comprising a multilayer imaging blanket, the multilayer imaging blanket comprising:

a seamless belt;

a silicone layer disposed on the belt, the silicone layer comprising silicone rubber and a metal oxide filler, wherein the silicone layer comprises a platinum cured siloxane; and a fluoroelastomer surface layer disposed on the silicone layer, where the fluoroelastomer surface layer is a fluoroelastomer-aminosilane grafted polymer composition;

a coating mechanism for forming a sacrificial coating onto the image transfer member;

a drying station for drying the sacrificial coating;

at least one ink jet nozzle positioned proximate the image transfer member and configured for jetting ink onto the sacrificial coating formed on the image transfer member;

an ink processing station comprising a radiation source for at least partially drying the ink on the sacrificial coating formed on the image transfer member; and a substrate transfer mechanism for moving a substrate into contact with the image transfer member.

13. The printing apparatus of claim 12, wherein the silicone rubber is present in the silicone layer in an amount ranging from about 80 to about 95 weight percent, based on the total weight of the silicone layer.

14. The printing apparatus of claim 12, wherein the fluoroelastomer surface layer further comprises infrared absorptive filler materials.

15. The printing apparatus of claim 12, wherein the drying station is positioned to dry the sacrificial coating before the jetting of the ink onto the sacrificial coating during a print process.

16. The printing apparatus of claim 12, wherein the radiation source is positioned on a side of the image transfer member on which the ink is jetted to allow for direct irradiation of the ink.

17. A printing apparatus comprising:

an image transfer member comprising a multilayer imaging blanket, the multilayer imaging blanket, comprising:

a seamless belt, wherein the belt is a freestanding polyimide film;

a silicone layer disposed on the belt, the silicone layer comprising silicone rubber and a metal oxide filler, wherein the silicone rubber is a platinum cured siloxane; and a fluoroelastomer surface layer disposed on the silicone layer, the fluoroelastomer surface layer comprising fluorosilicone made by mixing a vinyl terminated trifluoropropyl methylsiloxane polymer with platinum catalyst and a crosslinker, the crosslinker being a substituted or unsubstituted polysiloxane chain having at least one internal siloxane repeating unit with an Si-H bond;

a coating mechanism for applying a dampening fluid layer onto the image transfer member;

an optical patterning subsystem configured to selectively apply energy to portions of the dampening fluid layer to image-wise evaporate the dampening fluid layer and create a latent negative of an ink image that is desired to be printed on a receiving substrate;

an inker subsystem for applying ink composition to the image transfer member to form the ink image;

a rheology control subsystem for partially curing the ink image; and a substrate transfer mechanism for moving the receiving substrate into contact with the ink image.

18. The printing apparatus of claim 17, wherein the fluoroelastomer surface layer further comprises silica and carbon black.

* * * * *